US005494078A

United States Patent [19]

Schulte

[11] Patent Number: 5,494,078

[45] Date of Patent: Feb. 27, 1996

[54] PNEUMATIC LIFT DEVICE FOR DUAL FLOW VALVE

[75] Inventor: Robert J. Schulte, Bryan, Ohio

[73] Assignee: The ARO Corporation, Bryan, Ohio

[21] Appl. No.: 370,058

[22] Filed: Jan. 9, 1995

[51] Int. Cl.[6] ..... F16K 31/122

[52] U.S. Cl. ..... 137/630.14; 92/13.6; 92/62; 137/599.2; 251/63.4

[58] Field of Search ..... 92/13.6, 62; 137/599.2, 137/630.14, 630.15, 637.2; 251/63.4

[56] References Cited

U.S. PATENT DOCUMENTS 3,631,888 1/1972 Asperg ..... 137/630.15 X
4,274,444 6/1981 Ruyak ..... 137/630.14 X
4,928,544 5/1990 Markyvech ..... 92/62 X
5,301,714 4/1994 Johnson ..... 137/599.2

*Primary Examiner*—Robert G. Nilson
*Attorney, Agent, or Firm*—Walter C. Vliet

[57] ABSTRACT

Positive adjustable flow is provided for a dual flow valve for paint dispensing or the like utilizing a sliding piston and a lost motion device in combination with an adjustable stop and wherein operating lift is provided by a single pressure source alternatively applied to a plurality of operating pistons.

9 Claims, 1 Drawing Sheet

PNEUMATIC LIFT DEVICE FOR DUAL FLOW VALVE

BACKGROUND OF THE INVENTION

This invention relates generally to flow control devices and more particularly to a lift mechanism for a dual flow paint dispensing valve. Dual flow valves usually consist of a valve with two orifices. The flow is controlled by the amount the valve is opened. A force lifting the valve stem a short distance allows low flow, increasing the lift distance opens the high flow. The valves are generally held in the closed position by a spring, thus the farther open the valve the more force is required. When a pneumatic cylinder is the lifting device the amount the valve is opened is controlled by the amount of air pressure. Precisely controlling the air pressure is difficult and hence the precision flow control of the valve is limited to the extent the air pressure may be controlled.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a lift device for dual flow valve comprising a reciprocating flow control stem operatively engaged in one direction by a first piston reciprocating in a cylinder between defined limits of a forward stop and a rearward stop; a second piston operatively connected to the flow control stem and reciprocating in a second cylinder between defined limits of a forward position and a rearward position; a movable stop for adjusting the rearward position, and a lost motion means operable by the flow control stem to accumulate reciprocation of the flow control stem imparted in the one direction by reciprocation of the first piston.

The foregoing and other aspects will become apparent from the following detailed description of the invention when considered in conjunction with the accompanying drawing figures.

BRIEF DESCRIPTION OF THE DRAWING FIGURES

FIGURE 1 is a longitudinal cross section illustrating an embodiment of the present invention.

DETAILED DESCRIPTION

Figure 1:
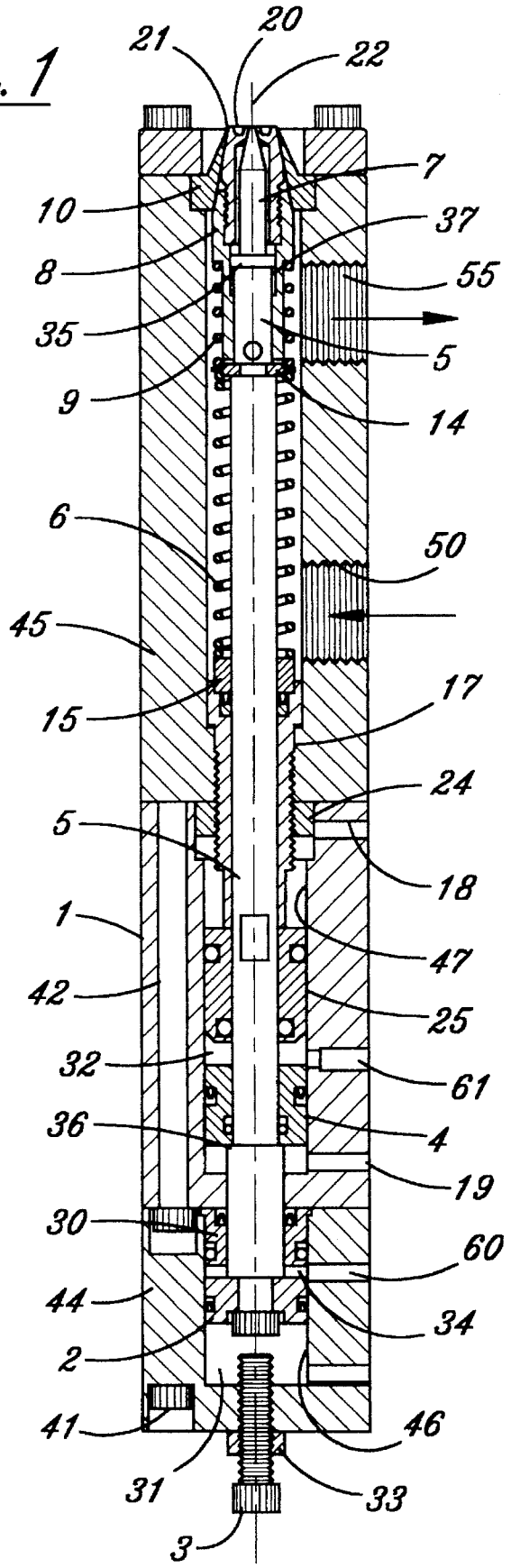

Referring to FIG. 1 a dual flow dispensing valve for paint, ink, or the like is shown. Incorporated in the valve is an improved pneumatic lifting device which allows flow adjustment for low and high flow without changing air pressure. This is desirable when several valves are being used as it simplifies connections and does not require a regulator for each valve. Repeatable flow and flow pattern may be accomplished since both the high and low flow lifts are independent of operating air pressure variation. Manufacture and assembly are also simplified without alignment problems. Servicing and trouble shooting is also improved. The amount the high flow orifice opens can be determined by the number of turns the adjustment screw is opened.

The valve and its adjustable lifting device is contained in three major body parts. A cylinder 1 which contains the pneumatic low flow actuation portion of the valve, a head 44 portion containing a high flow pneumatic action portion of the valve and an adjustable stop, and a fluid dispensing base housing 45 to which is introduced a pressurized paint or ink supply which is further distributed on valve actuation through a high and/or low flow orifice. Each of the three major components is generally constructed of a rectangular cross section housing having an axially aligned bore running through it in axial alignment with its corresponding component. The entire assembly is bolted together by means of bolts as will now be more particularly described.

The head 44 is provided with a circular bore 46. A piston guide and chamber seal 30 is inserted in the bore 46 and positioned therein by abutment with the cylinder housing 1. A high flow actuation piston 2 is inserted in the bore 46 for reciprocation therein. An extended stem 5 of the piston cooperates with the piston seal and guide 30 and extends to a flow control tip 7. A high flow stop screw 3 extends through the head 44 into piston chamber 31. The high flow stop screw 3 is threadingly engaged in the head 44 and extends into the head space 31 to limit the travel of the piston 2 and hence the travel of stem. Its position relative to the head of the high flow piston is retained by means of a stop nut 33. An actuation high flow chamber 34 is formed between the stop piston 2 and the piston guide and chamber seal 30.

Air enters the high flow chamber 34 by means of a high flow air supply port 60. As will be appreciated by one skilled in the art, pressure air supplied to the port 60 will force the high flow actuation piston 2 downward and hence retract the stem 5 as far as permitted by stop screw 3. Removal of the air supply at port 60 will allow the piston 2 to return.

The cylinder 1 is provided with a bore 47 having a stem piston 4 reciprocally disposed within it. Also disposed within the bore 47 is a piston chamber seal 25 which forms a low flow actuation chamber 32 between the piston seal 25 and the stem piston 4. The stem 5 is slidingly engaged in the piston 4 and extends in reciprocating sliding contact through the piston seat and chamber seal 25. As shown, sliding engagement of piston 4 with stem 5 is limited by shoulder 36.

The piston seat 25 is positioned within the bore 47 by means of a guide 17 which is threadingly engaged with the fluid handling base 45 and secured there by means of a stop nut 24. The chamber formed between the fluid base 45 and the piston seat 25 is vented by means of a bleed vent 18. Pressurized air supplied to port 61 enters the chamber 32 formed between the piston 4 and the piston seat 25.

When the chamber 32 is pressurized, the piston 4 is forced downward against shoulder 36, as shown in FIG. 1, thus drawings with it the stem 5. Movement of the stem 5 compresses stem spring 6 between a stop 15 and a spring stop 14. Upon release of air pressure in port 61, the stem spring 6 returns the stem upward as shown in FIG. 1.

When the stem 5 moves down it withdraws tip 7 from the low flow orifice 22 thereby permitting paint or the like supplied at port 50 to be dispensed through slots (not shown) in tip holder 8 of the orifice tip 20. Spring 9 acting against spring stop 14 urges the tip holder 8 and hence the orifice tip 20 to remain in contact with the high flow orifice seat 10. The spring 9 will hold the orifice tip in place until the "lost motion" stop 35 contacts the tip holder 8 at shoulder 37. Further motion will then withdraw the orifice tip 20 allowing a high flow of paint or the like to pass through the high flow orifice 21.

Deployment of the high flow piston 2 as previously described by pressurizing air supply port 60 produces the further movement required as limited by stop 3.

A paint return port 55 permits a constant flow of paint to the paint dispensing valve and also provides a means for circulating cleaning fluid through the valve when required. Assembly of the head 44 to the cylinder 1 is accomplished by means of head bolts 42 and the cylinder 1 is attached to the fluid housing base 45 by means of cylinder bolts 41. A retainer for the orifice seat 10 is attached to the base 45 by means of retainer bolts 12.

A square cross section of the valve has been found to provide a convenient shape for stacking the valve, however, a circular cross section is also convenient.

Having described my invention in terms of a lift mechanism for a paint dispensing valve, numerous alternatives will occur to one skilled in the art. I do not wish to be limited in the scope of my invention except as claimed.

What is claimed is:

1. A lift device for a dual flow valve comprising:

a reciprocating flow control stem operatively engaged in one direction by a first piston reciprocating in a cylinder between defined limits of a forward stop and a rearward stop;

a second piston operatively connected to said flow control stem and reciprocating in a second cylinder between defined limits of a forward position and a rearward position;

a movable stop for adjusting said rearward position; and a lost motion means operable by said flow control stem to accumulate reciprocation of said flow control stem imparted in said one direction by reciprocation of said first piston.

2. A lift device for dual flow valve according to claim 1 wherein:

said movable stop and thus said rearward position is externally adjustable.

3. A lift device for dual flow valve according to claim 1 wherein:

said first piston and said second piston are pneumatically deployed.

4. A lift device for dual flow valve according to claim 1 wherein:

said dual flow valve is a paint dispensing valve.

5. A lift device for dual flow valve according to claim 1 wherein:

said dual flow valve is an ink dispensing valve.

6. A lift device for dual flow valve according to claim 1, wherein:

said lost motion means is for accumulating a difference in motion for deployment of a first and second orifice dispensing means.

7. A lift device for dual flow valve according to claim 6 wherein:

said lost motion means is deployed between a stem connected to said second piston and a high flow orifice.

8. A lift device for dual flow valve according to claim 6 wherein:

said stem directly operates a low flow orifice.

9. A lift device for a dual flow valve for dispensing paint, comprising:

a reciprocating flow control stem operatively engaged in one direction by a first piston reciprocating in a cylinder between defined limits of a forward stop and a rearward stop;

a second piston operatively connected to said flow control stem and reciprocating in a second cylinder between defined limits of a forward position and a rearward position;

a movable stop for adjusting said rearward position; and a lost motion means operable by said flow control stem to accumulate reciprocation of said flow control stem imparted in said one direction by reciprocation of said first piston.

* * * * *